US012029304B2

(12) United States Patent
He et al.

(10) Patent No.: US 12,029,304 B2
(45) Date of Patent: Jul. 9, 2024

(54) PAPER LIPSTICK TUBE WITH THREADS

(71) Applicant: Dongguan Fengcai Technology Co., Ltd, Guangdong (CN)

(72) Inventors: Jing He, Sichuan (CN); Guorui Deng, Kowloon (CN)

(73) Assignee: Dongguan Fengcai Technology Co., Ltd, Guangdong (CN)

( * ) Notice: Subject to any disclaimer, the term of this patent is extended or adjusted under 35 U.S.C. 154(b) by 0 days.

(21) Appl. No.: 18/077,161

(22) Filed: Dec. 7, 2022

(65) Prior Publication Data

US 2024/0130508 A1 Apr. 25, 2024

(30) Foreign Application Priority Data

Oct. 20, 2022 (CN) ..... 202222775887.4

(51) Int. Cl.
*A45D 40/06* (2006.01)
*A45D 40/02* (2006.01)
*A45D 40/04* (2006.01)

(52) U.S. Cl.
CPC ..... *A45D 40/06* (2013.01); *A45D 40/023* (2013.01); *A45D 40/04* (2013.01)

(58) Field of Classification Search
CPC ..... A45D 40/06; A45D 40/40; A45D 40/023; A45D 40/00; A45D 2040/0012; A45D 2040/0025; A45D 40/02; A45D 40/04; A45D 40/205; A45D 2040/208; B65D 83/0005; B65D 83/0011; B65D 83/0022
USPC ..... 401/75–78, 171–174
See application file for complete search history.

(56) References Cited

U.S. PATENT DOCUMENTS 5,649,777 A * 7/1997 Holloway ..... A45D 40/16 401/74
11,344,100 B1 * 5/2022 Shugar ..... A45D 40/02
2004/0265033 A1 * 12/2004 Kurihara ..... A45D 40/06 401/68

* cited by examiner

*Primary Examiner* — David J Walczak
(74) *Attorney, Agent, or Firm* — JCIPRNET

(57) ABSTRACT

A paper lipstick tube with threads, including a lipstick tube body which includes an A lipstick tubing, a B lipstick tubing, a C lipstick tubing, a pin, a D lipstick tubing, an F lipstick tubing, an M lipstick tubing, a K lipstick tubing, a cover tube H, a circular gasket and cream. The B lipstick tubing is rotatably installed inside the F lipstick tubing. The lipstick tube body is a container with a push-pull function made of only paper and a small amount of natural bamboo or wood materials. Through mutual rotation of the F lipstick tubing and the B lipstick tubing, upward and downward shearing forces are applied to the pin spirally through the threaded groove in the B lipstick tubing. At the same time, the pin is also in up-and-down guide openings of the D lipstick tubing, so that the C lipstick tubing can only move up and down.

7 Claims, 7 Drawing Sheets

PAPER LIPSTICK TUBE WITH THREADS

CROSS-REFERENCE TO RELATED APPLICATION

This application claims the priority benefit of China application no. 202222775887.4, filed on Oct. 20, 2022. The entirety of the above-mentioned patent application is hereby incorporated by reference herein and made a part of this specification.

BACKGROUND

Technical Field

The present invention relates to the technical field of lipstick tubes, and in particular to a paper lipstick tube with threads.

Description of Related Art

Lipstick is a general term for all lip makeup. Because of the complex structure and function, the quality of lipstick tube packaging materials for packaging lipstick products is difficult to control. A lipstick tube is a functional package composed of multiple components and different materials. In terms of product materials, it is further divided into volatile type and non-volatile type or airtight type and non-airtight type. In addition, most of the filling is automatic filling by machines, including pre-filling, post-filling, direct filling and so on. Loading of lipstick tubes is very complicated. A wrong combination of different parts, a poor tolerance control, or an unreasonable design, even if lubricating oil is applied in a wrong way, will cause a lipstick preparation equipment to shut down or function abnormally. These mistakes are all fatal.

Traditional lipstick tubes have the following disadvantages.

(1) The traditional lipstick tubes use similar metal or plastic molding technologies to process threads and guide rails, such that telescopic motion of fittings in lipstick tube containers can take place when rotating, thus realizing a push-pull function of container contents, which undoubtedly increases the preparation cost of the lipstick tubes.

(2) The traditional lipstick tubes are made of metal or plastic raw materials, which are not environmentally friendly.

SUMMARY

The purpose of the present invention is to provide a paper lipstick tube with threads, in order to solve the above problems proposed in the background art that the traditional lipstick tubes use similar metal or plastic molding technologies to process threads and guide rails, such that telescopic motion of fittings in lipstick tube containers can take place when rotating, thus realizing a push-pull function of container contents, which undoubtedly increases the preparation cost of the lipstick tubes; and the traditional lipstick tubes are made of metal or plastic raw materials, which are not environmentally friendly.

In order to achieve the above purpose, the present invention provides the following technical solution: a paper lipstick tube with threads, including a lipstick tube body, where the lipstick tube body includes an A lipstick tubing, a B lipstick tubing, a C lipstick tubing, a pin, a D lipstick tubing, an F lipstick tubing, an M lipstick tubing, a K lipstick tubing, a cover tube H, a circular gasket and cream, where the B lipstick tubing is rotatably installed inside the F lipstick tubing, the A lipstick tubing is connected to the middle of the B lipstick tubing in an adhesive manner, the D lipstick tubing is installed inside the B lipstick tubing, the C lipstick tubing is installed inside the D lipstick tubing, the surface of the B lipstick tubing is provided with a threaded groove, both sides of the D lipstick tubing are provided with guide openings, the middle of the C lipstick tubing is provided with a radial hole, and the pin which sequentially passes through the guide openings and the threaded groove is installed inside the radial hole. Through mutual rotation of the F lipstick tubing and the B lipstick tubing, upward and downward shearing forces are applied to the pin spirally through the threaded groove in the B lipstick tubing. At the same time, the pin is also in the up-and-down guide openings of the D lipstick tubing, so that the C lipstick tubing can only move up and down.

Preferably, the circular gasket is connected to a bottom end of an inner wall of the F lipstick tubing in an adhesive manner, the M lipstick tubing located outside the B lipstick tubing is connected to the bottom end of the inner wall of the F lipstick tubing 6 in an adhesive manner, the K lipstick tubing located outside the B lipstick tubing is connected to a top end of the inner wall of the F lipstick tubing in an adhesive manner, the cream is installed on the top of the C lipstick tubing, the cover tube H is connected to the top of the F lipstick tubing in a snapped manner, and a section of limiting paper tube (i.e., the M lipstick tubing) is bonded to the inner wall of the outer tube (i.e., the F lipstick tubing) to limit the position of the B lipstick tubing from the bottom.

Preferably, the middle of a top end of the circular gasket is connected to a bottom end of the D lipstick tubing in an adhesive manner, and the circular gasket and the D lipstick tubing are bonded as a whole.

Preferably, the B tubing bonded with the A tubing is inserted into the F tubing, the K tubing is then inserted into a gap between the F tubing and the B tubing (with the lower edge of the K tubing being in contact with the upper edge of the A tubing), and the outer side of the K lipstick tubing is connected to the inner side of the F lipstick tubing in an adhesive manner to limit the position of the B lipstick tubing from the top so that it cannot come out of the F tubing.

Preferably, the length of the pin is smaller than the outer diameter of the B lipstick tubing and the length of the pin is greater than the inner diameter of the B lipstick tubing, and the pin sequentially passes through the radial hole, the guide openings and the threaded groove.

Preferably, the diameter of the radial hole is equal to the diameter of the pin, the outer diameter of the D lipstick tubing is smaller than the inner diameter of the B lipstick tubing, the outer diameter of the paper tube prepared with the guide openings (i.e., the D lipstick tubing) is smaller than the inner diameter of the B lipstick tubing, the B lipstick tubing and the D lipstick tubing can rotate relative to each other, and the outer diameter of the C lipstick tubing is smaller than the inner diameter of the D lipstick tubing.

Preferably, the A lipstick tubing, the B lipstick tubing, the C lipstick tubing, the D lipstick tubing, the F lipstick tubing, the M lipstick tubing, the K lipstick tubing and the cover tube H are all made of paper materials. The pin is made of natural bamboo or wood material. The lipstick tube body is a container with a push-pull function made of only paper and a small amount of natural bamboo/wood. The preparation cost of the lipstick tube body is low, which is environment-friendly and energy-saving.

Compared with the prior art, the beneficial effects of the present invention are as follows:

1. The lipstick tube body is a container with a push-pull function made of only paper and a small amount of natural bamboo/wood. Through the mutual rotation of the F lipstick tubing and the B lipstick tubing, upward and downward shearing forces are applied to the pin spirally through the threaded groove in the B lipstick tubing. At the same time, the pin is also in the up-and-down guide openings of the D lipstick tubing, so that the C lipstick tubing can only move up and down. This realizes a function that the product will not rotate by itself in the process of rotating, pushing and pulling, and the preparation cost of the lipstick tube body is low.
2. Plastic and metal materials are completely removed from the lipstick tube body, which avoids the waste lipstick tube body from polluting the environment, and is environment-friendly and energy-saving.

DESCRIPTION OF THE EMBODIMENTS

The technical solution in the embodiments of the present invention will be clearly and completely described below in conjunction with the accompanying drawings of the embodiments of the present invention.

Figure 1:
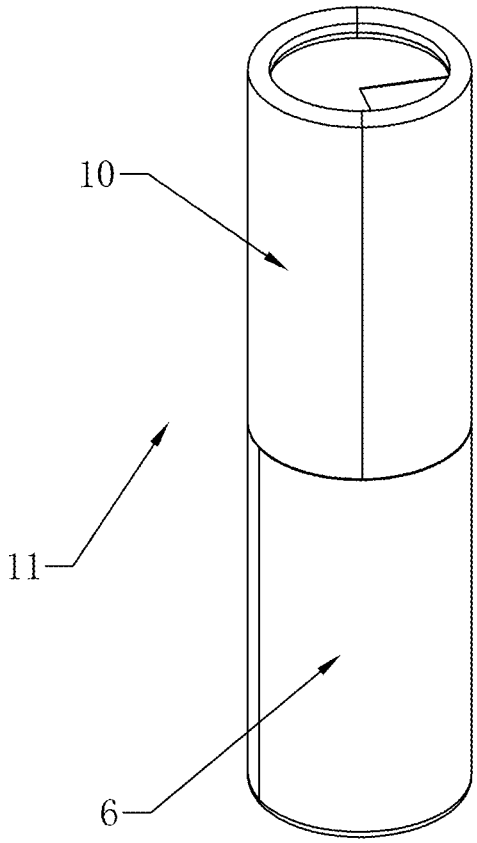
FIG. 1 is an isometric diagram of the present invention.
Figure 2:
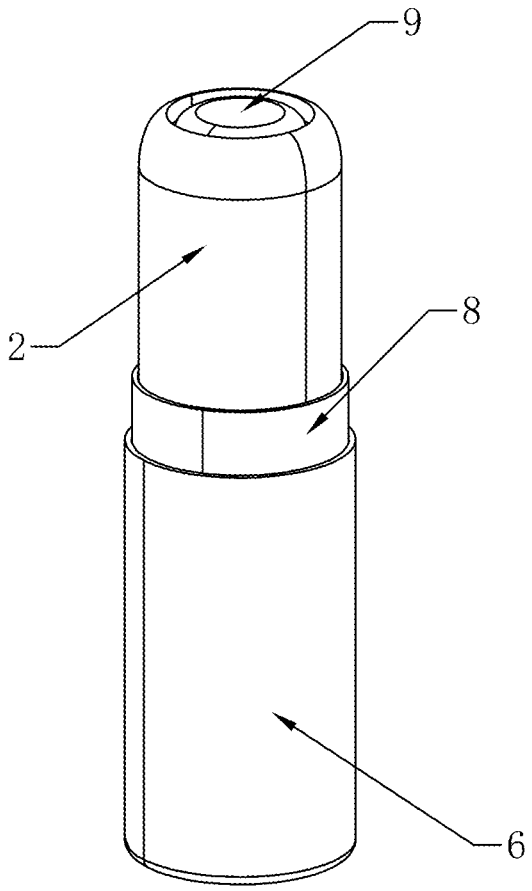
FIG. 2 is a connection diagram of an F lipstick tubing and a K lipstick tubing of the present invention.
Figure 3:
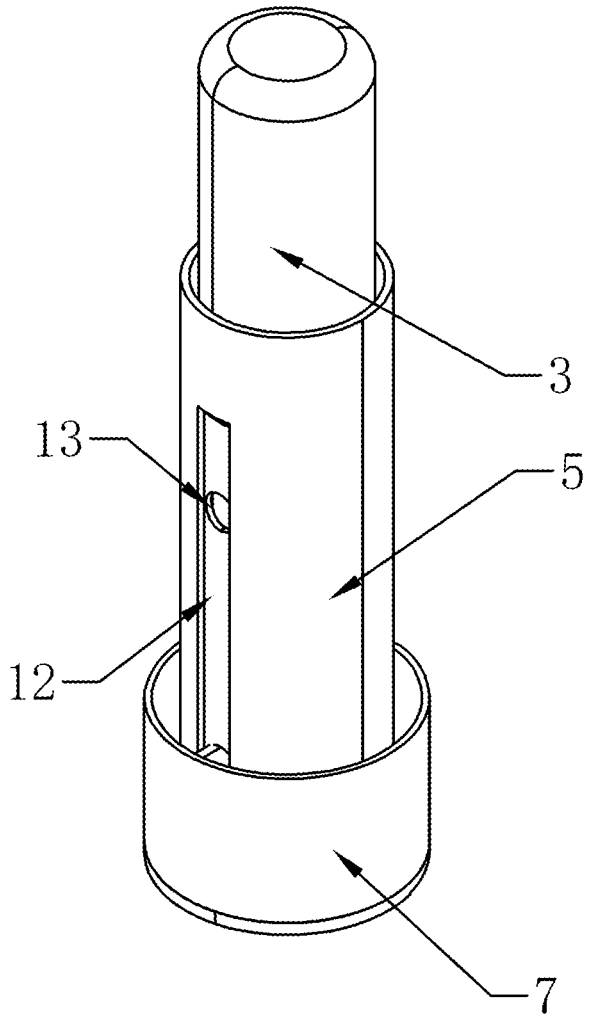
FIG. 3 is a connection diagram of a D lipstick tubing and a C lipstick tubing of the present invention.
Figure 4:
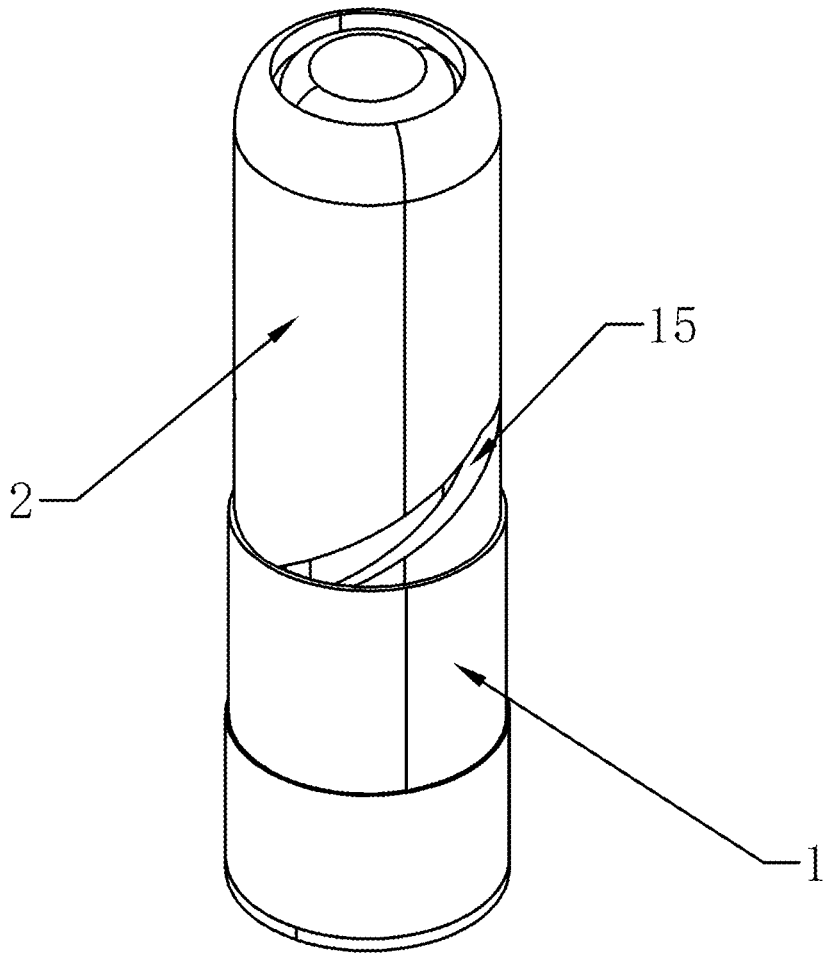
FIG. 4 is a connection diagram of a B lipstick tubing and an A lipstick tubing of the present invention.
Figure 5:
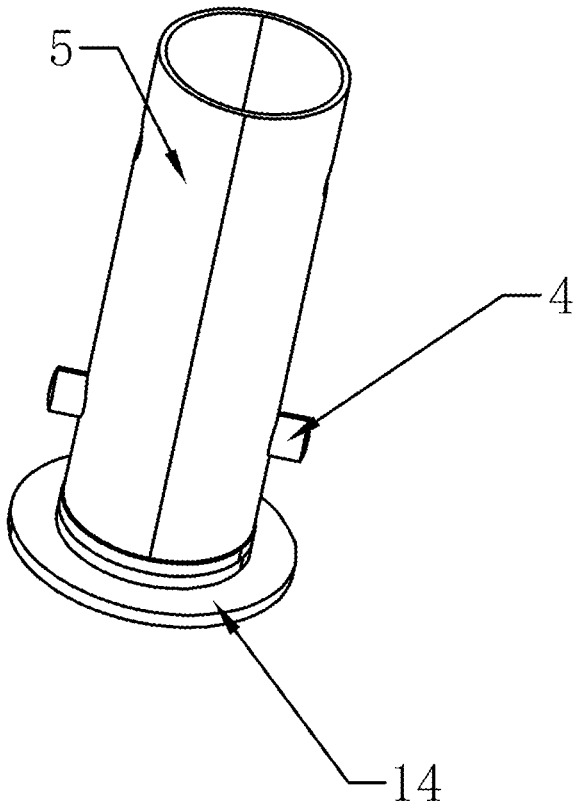
FIG. 5 is a connection diagram of a circular gasket and a D lipstick tubing of the present invention.
Figure 6:
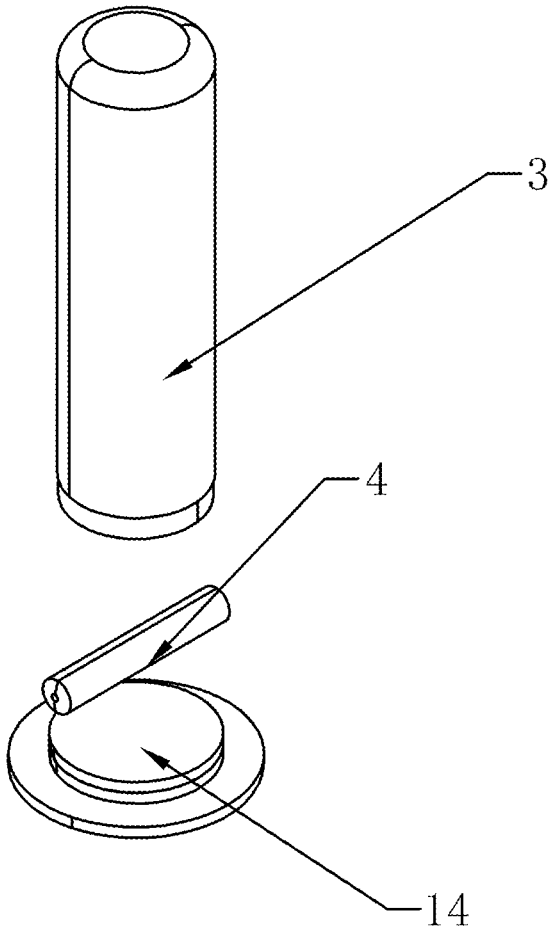
FIG. 6 is a connection diagram of a C lipstick tubing and a pin of the present invention.
Figure 7:
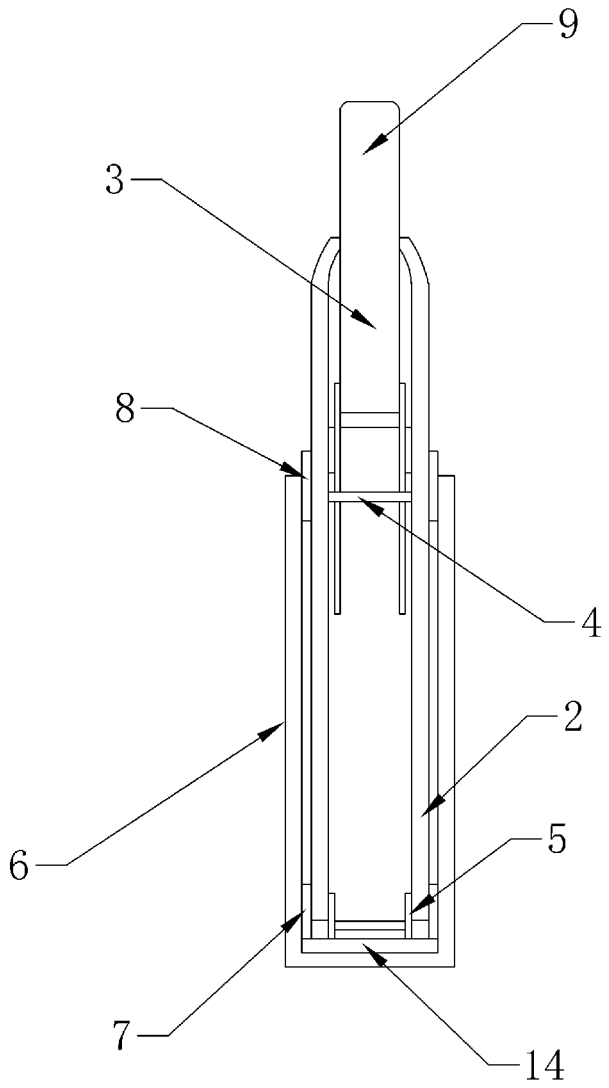
FIG. 7 is a schematic structural diagram of the present invention.

Referring to FIGS. 1-7, the present invention provides a paper lipstick tube with threads, including a lipstick tube body 11, where the lipstick tube body 11 includes an A lipstick tubing 1, a B lipstick tubing 2, a C lipstick tubing 3, a pin 4, a D lipstick tubing 5, an F lipstick tubing 6, an M lipstick tubing 7, a K lipstick tubing 8, a cover tube H 10, a circular gasket 14 and cream 9, where the B lipstick tubing 2 is rotatably installed inside the F lipstick tubing 6, the A lipstick tubing 1 is connected to the middle of the B lipstick tubing 2 in an adhesive manner, the D lipstick tubing 5 is installed inside the B lipstick tubing 2, the C lipstick tubing 3 is installed inside the D lipstick tubing 5, the surface of the B lipstick tubing 2 is provided with a threaded groove 15, both sides of the D lipstick tubing 5 are provided with guide openings 12, the middle of the C lipstick tubing 3 is provided with a radial hole 13, and the pin 4 which sequentially passes through the guide openings 12 and the threaded groove 15 is installed inside the radial hole 13. Through mutual rotation of the F lipstick tubing 6 and the B lipstick tubing 2, upward and downward shearing forces are applied to the pin 4 spirally through the threaded groove 15 in the B lipstick tubing 2. At the same time, the pin 4 is also in the up-and-down guide openings 12 of the D lipstick tubing 5, so that the C lipstick tubing 3 can only move up and down.

The circular gasket 14 is connected to a bottom end of an inner wall of the F lipstick tubing 6 in an adhesive manner, the M lipstick tubing 7 located outside the B lipstick tubing 2 is connected to the bottom end of the inner wall of the F lipstick tubing 6 in an adhesive manner, the K lipstick tubing 8 located outside the B lipstick tubing 2 is connected to a top end of the inner wall of the F lipstick tubing 6 in an adhesive manner, the cream 9 is installed on the top of the C lipstick tubing 3, the cover tube H 10 is connected to the top of the F lipstick tubing 6 in a snapped manner, and a section of limiting paper tube (i.e., the M lipstick tubing 7) is bonded to the inner wall of the outer tube (i.e., the F lipstick tubing 6) to limit the position of the B lipstick tubing from the bottom.

The middle of a top end of the circular gasket 14 is connected to a bottom end of the D lipstick tubing 5 in an adhesive manner, and the circular gasket 14 and the D lipstick tubing 5 are bonded as a whole.

The B tubing bonded with the A tubing is inserted into the F tubing, the K tubing is then inserted into a gap between the F tubing and the B tubing (with the lower edge of the K tubing being in contact with the upper edge of the A tubing), and the outer side of the K lipstick tubing is connected to the inner side of the F lipstick tubing in an adhesive manner to limit the position of the B lipstick tubing from the top so that it cannot come out of the F tubing.

The length of the pin 4 is smaller than the outer diameter of the B lipstick tubing 2 and the length of the pin 4 is greater than the inner diameter of the B lipstick tubing 2, and the pin 4 sequentially passes through the radial hole 13, the guide openings 12 and the threaded groove 15.

The diameter of the radial hole 13 is equal to the diameter of the pin 4, the outer diameter of the D lipstick tubing 5 is smaller than the inner diameter of the B lipstick tubing 2, the outer diameter of the paper tube prepared with the guide openings 12 (i.e., the D lipstick tubing 5) is smaller than the inner diameter of the B lipstick tubing 2, the B lipstick tubing 2 and the D lipstick tubing 5 can rotate relative to each other, and the outer diameter of the C lipstick tubing 3 is smaller than the inner diameter of the D lipstick tubing 5.

The A lipstick tubing 1, the B lipstick tubing 2, the C lipstick tubing 3, the D lipstick tubing 5, the F lipstick tubing 6, the M lipstick tubing 7, the K lipstick tubing 8 and the cover tube H 10 are all made of paper materials. The pin 4 is made of natural bamboo or wood material. The lipstick tube body 11 is a container with a push-pull function made of only paper and a small amount of natural bamboo/wood. The preparation cost of the lipstick tube body 11 is low, which is environment-friendly and energy-saving.

When embodiments of the present application are applied, a paper tube with threads (i.e., the B lipstick tubing 2) is prepared, preferably with symmetrical double threads, a small section of sleeve (i.e., the A lipstick tubing 1) is bonded to the middle of the B lipstick tubing 2, and a paper tube with guide openings 12 (i.e., the D lipstick tubing 5) is prepared, where the outer diameter of D lipstick tubing 5 is smaller than the inner diameter of the B lipstick tubing 2, so that the two can rotate relatively; a loading tube (i.e., the C lipstick tubing 3) with a radial hole 13 in the diameter direction is prepared, where the bore diameter of the radial hole 13 is equal to the diameter of the pin 4, and the outer diameter of the C lipstick tubing 3 is smaller than the inner diameter of the D lipstick tubing 5; the pin 4 made of natural wood or natural bamboo as a raw material is prepared, where the length of the pin 4 is smaller than the outer diameter of the B lipstick tubing 2 and larger than the inner diameter of the B lipstick tubing 2; the C lipstick tubing 3, the D lipstick tubing 5 and the B lipstick tubing 2 are sleeved in turn, and the pin 4 is inserted through the threaded groove 15 of the B lipstick tubing 2, the guide openings 12 of the D lipstick tubing 5 and the radial hole 13 of the C lipstick tubing 3 to form a combination X; and the outer tube (i.e., the F lipstick tubing 6) and limiting tubes (i.e., the K lipstick tubing 8 and the M lipstick tubing 7) are prepared, a section of limiting paper tube (i.e., the M lipstick tubing 7) is bonded to the inner wall of the outer tube (i.e., the F lipstick tubing 6), the circular gasket 14 at the bottom of the combination is bonded with the bottom of the F lipstick tubing 6 as a whole, the limiting tube (i.e., the K lipstick tubing 8) is inserted into the outer tube (i.e., the F lipstick tubing 6), and bonded into a whole after being close to the upper edge of the A lipstick tubing 1, and then the prepared cover tube H 10 is sleeved.

Although the present invention has been described in detail with reference to the foregoing embodiments, for those skilled in the art, the technical solution recorded in the foregoing embodiments may still be modified, or some technical features therein may be equivalently replaced. Any modifications, equivalent replacements, improvements, and the like made within the spirit and principle of the present invention shall be included into the scope of protection of the present invention.

What is claimed is:

1. A paper lipstick tube with threads, comprising a lipstick tube body, wherein the lipstick tube body comprises an A lipstick tubing, a B lipstick tubing, a C lipstick tubing, a pin, a D lipstick tubing, an F lipstick tubing, an M lipstick tubing, a K lipstick tubing, a cover tube H, a circular gasket and cream, wherein the B lipstick tubing is rotatably installed inside the F lipstick tubing, the A lipstick tubing is connected to a middle of the B lipstick tubing in an adhesive manner, the D lipstick tubing is installed inside the B lipstick tubing, the C lipstick tubing is installed inside the D lipstick tubing, a surface of the B lipstick tubing is provided with a threaded groove, both sides of the D lipstick tubing are provided with guide openings, a middle of the C lipstick tubing is provided with a radial hole, and the pin which sequentially passes through the guide openings and the threaded groove is installed inside the radial hole, wherein the A lipstick tubing, the B lipstick tubing, the C lipstick tubing, the D lipstick tubing, the F lipstick tubing, the M lipstick tubing, the K lipstick tubing and the cover tube H are all made of paper materials.

2. The paper lipstick tube with threads according to claim 1, wherein the circular gasket is connected to a bottom end of an inner wall of the F lipstick tubing in an adhesive manner, the M lipstick tubing located outside the B lipstick tubing is connected to the bottom end of the inner wall of the F lipstick tubing in an adhesive manner, the K lipstick tubing located outside the B lipstick tubing is connected to a top end of the inner wall of the F lipstick tubing in an adhesive manner, the cream is installed on a top of the C lipstick tubing, and the cover tube H is connected to a top of the F lipstick tubing in a snapped manner.

3. The paper lipstick tube with threads according to claim 1, wherein a middle of a top end of the circular gasket is connected to a bottom end of the D lipstick tubing in an adhesive manner.

4. The paper lipstick tube with threads according to claim 1, wherein an outer side of the K lipstick tubing is connected to an inner side of the F lipstick tubing in an adhesive manner.

5. The paper lipstick tube with threads according to claim 1, wherein a length of the pin is smaller than an outer diameter of the B lipstick tubing and the length of the pin is greater than an inner diameter of the B lipstick tubing.

6. The paper lipstick tube with threads according to claim 1, wherein a diameter of the radial hole is equal to a diameter of the pin, and an outer diameter of the D lipstick tubing is smaller than an inner diameter of the B lipstick tubing.

7. The paper lipstick tube with threads according to claim 1, wherein the pin is made of natural bamboo or wood material.

* * * * *